US008749602B2

(12) United States Patent
Koroishi et al.

(10) Patent No.: US 8,749,602 B2
(45) Date of Patent: Jun. 10, 2014

(54) METHOD OF MANUFACTURING THERMAL HEAD, AND THERMAL PRINTER

(71) Applicant: Seiko Instruments Inc., Chiba (JP)

(72) Inventors: Keitaro Koroishi, Chiba (JP); Norimitsu Sanbongi, Chiba (JP); Noriyoshi Shoji, Chiba (JP); Toshimitsu Morooka, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 13/680,914

(22) Filed: Nov. 19, 2012

(65) Prior Publication Data

US 2013/0141507 A1 Jun. 6, 2013

(30) Foreign Application Priority Data

Dec. 1, 2011 (JP) ..... 2011-263967

(51) Int. Cl.
*B41J 2/34* (2006.01)

(52) U.S. Cl.
USPC ..... 347/200; 347/204; 347/206

(58) Field of Classification Search
CPC ..... B41J 2/335; B41J 2/34; B41J 2/345
USPC ..... 347/200, 202
See application file for complete search history.

(56) References Cited

U.S. PATENT DOCUMENTS 4,907,015 A * 3/1990 Kaneko et al. ..... 347/204
5,206,662 A * 4/1993 Fox et al. ..... 347/198
5,272,489 A * 12/1993 Kobayashi et al. ..... 347/206
5,594,488 A * 1/1997 Tsushima et al. ..... 347/208
5,821,975 A * 10/1998 Gunther et al. ..... 347/217
6,141,029 A * 10/2000 Gunther et al. ..... 347/217
6,597,387 B1 * 7/2003 Chien ..... 347/212
6,606,109 B1 * 8/2003 Takizawa t al. ..... 347/208
6,686,945 B1 * 2/2004 Takizawa et al. ..... 347/208
8,169,452 B2 * 5/2012 Morooka et al. ..... 347/206
8,189,021 B2 * 5/2012 Morooka et al. ..... 347/206
8,189,022 B2 * 5/2012 Koroishi et al. ..... 347/206
8,253,765 B2 * 8/2012 Shoji et al. ..... 347/200
8,372,296 B2 * 2/2013 Shoji et al. ..... 216/13
8,384,749 B2 * 2/2013 Morooka et al. ..... 347/200
8,477,166 B2 * 7/2013 Morooka et al. ..... 347/208
2002/0024582 A1 * 2/2002 Shirakawa et al. ..... 347/208
2002/0044193 A1 * 4/2002 Sambongi ..... 347/208

(Continued)

FOREIGN PATENT DOCUMENTS

JP 2011-037018 A 2/2011

*Primary Examiner* — Matthew Luu
*Assistant Examiner* — Lily Kemathe
(74) *Attorney, Agent, or Firm* — Brinks Gilson & Lione

(57) ABSTRACT

A method of manufacturing a thermal head, comprising the steps of: bonding a support substrate and an upper substrate, which have a flat shape, together in a laminated state, the support substrate and the upper substrate having opposed surfaces, at least one of which includes a concave portion; thinning the upper substrate bonded onto the support substrate; a measurement step of measuring a thickness of the thinned upper substrate; determining a target resistance value of a heating resistor from the following expression based on the measured thickness of the upper substrate; and forming the heating resistor having the target resistance value at a position opposed to the concave portion, $Rh=R0\times(1+(D1+D0)/(D0+K))$ where Rh represents the target resistance value; R0, a design resistance value; D1, the thickness of the upper substrate; D0, a design thickness of the upper substrate; and K, a heating efficiency coefficient.

5 Claims, 7 Drawing Sheets

(56) References Cited

U.S. PATENT DOCUMENTS

| | | | | |
|---|---|---|---|---|
| 2007/0091161 | A1* | 4/2007 | Shoji et al. | 347/200 |
| 2009/0090703 | A1* | 4/2009 | Morooka et al. | 219/201 |
| 2009/0102891 | A1* | 4/2009 | Koroishi et al. | 347/62 |
| 2009/0262176 | A1* | 10/2009 | Shoji et al. | 347/206 |
| 2009/0265919 | A1* | 10/2009 | Shoji et al. | 29/611 |
| 2010/0071414 | A1* | 3/2010 | Morooka et al. | 65/17.3 |
| 2010/0134581 | A1* | 6/2010 | Koroishi et al. | 347/200 |
| 2010/0134583 | A1* | 6/2010 | Koroishi et al. | 347/206 |
| 2010/0140215 | A1* | 6/2010 | Sanbongi et al. | 216/27 |
| 2011/0018952 | A1* | 1/2011 | Koroishi et al. | 347/197 |
| 2011/0025808 | A1* | 2/2011 | Sanbongi | 347/200 |
| 2011/0031212 | A1* | 2/2011 | Shoji et al. | 216/27 |
| 2011/0074907 | A1* | 3/2011 | Morooka et al. | 347/220 |
| 2012/0073123 | A1* | 3/2012 | Shoji et al. | 29/610.1 |
| 2012/0212558 | A1* | 8/2012 | Morooka et al. | 347/208 |

* cited by examiner

METHOD OF MANUFACTURING THERMAL HEAD, AND THERMAL PRINTER

RELATED APPLICATIONS

This application claims priority under 35 U.S.C. §119 to Japanese Patent Application No. 2011-263967 filed on Dec. 1, 2011, the entire content of which is hereby incorporated by reference.

BACKGROUND OF THE INVENTION

1. Field of the Invention

The present invention relates to a method of manufacturing a thermal head, and a thermal printer.

2. Description of the Related Art

As a method of manufacturing a thermal head to be used in a thermal printer, there is known a method of forming an opening portion in one surface of a support substrate and bonding an upper substrate onto the support substrate in a laminated state so as to close the opening portion. In this manufacturing method, a heating resistor is formed on a surface of the upper substrate at a position opposed to the opening portion across the upper substrate, and then a protective film is formed to cover the heating resistor and the surface of the upper substrate, to thereby manufacture a thermal head having a cavity portion formed therein between the support substrate and the upper substrate.

In this case, a resistance value of the heating resistor is adjusted based on a thickness dimension of the upper substrate, and hence it is possible to easily manufacture a highly-efficient thermal head capable of accurately outputting a target heating amount that takes into account the amount of heat which is not utilized and wasted.

In the above-mentioned manufacturing method, the thickness dimension of the upper substrate is divided into sections at predetermined intervals, and a database that stores the resistance value of the heating resistor in association with each section is prepared. After the thickness dimension of the upper substrate is measured, the resistance value of the heating resistor corresponding to the measured thickness dimension is read from the database, and the resistance value of the heating resistor is adjusted.

However, the resistance value of the heating resistor varies for each substrate or each lot. Therefore, there is a disadvantage in that, in the vicinity of both ends of each section of the thickness dimension of the upper substrate, a proper resistance value cannot be obtained, resulting in lowering heating efficiency.

Therefore, in this field, a method of manufacturing a thermal head, and a thermal printer which are capable of suppressing the variation in heating efficiency caused by the variation in resistance value among substrates or lots have been sought after.

SUMMARY OF THE INVENTION

According to an exemplary embodiment of the present invention, there is provided a method of manufacturing a thermal head, including: bonding a support substrate and an upper substrate, which have a flat shape, together in a laminated state, the support substrate and the upper substrate having opposed surfaces, at least one of which includes a concave portion; thinning the upper substrate bonded onto the support substrate in the bonding; measuring a thickness of the upper substrate thinned in the thinning; determining a target resistance value of a heating resistor from Expression (1) below based on the thickness of the upper substrate measured in the measuring; and forming the heating resistor having the target resistance value determined in the determining on a surface of the upper substrate thinned in the thinning at a position opposed to the concave portion, $$Rh=R0\times(1+(D1+D0)/(D0+K)) \quad (1)$$

where Rh represents the target resistance value; R0, a design resistance value; D1, the thickness of the upper substrate; D0, a design thickness of the upper substrate; and K, a heating efficiency coefficient.

According to this exemplary embodiment, in the bonding step, the upper substrate and the support substrate are bonded together to close the concave portion, to thereby form a cavity portion between the upper substrate and the support substrate. The cavity portion functions as a hollow heat-insulating layer for insulating heat transferred from the upper substrate side to the support substrate side. Then, in the thinning step, the upper substrate is thinned, to thereby reduce a heat capacity of the upper substrate.

After that, in the resistor forming step, the heating resistor is formed on the surface of the upper substrate at the position opposed to the concave portion. Of the amount of heat generated by the heating resistor, an amount of heat that dissipates to the upper substrate side is suppressed by the thinning of the upper substrate and the heat insulation of the cavity portion. Thus, the available amount of heat can be increased.

In this case, the available amount of heat depends on the resistance value of the heating resistor and the thickness of the upper substrate. Therefore, the thickness of the thinned upper substrate is measured in the measurement step, and the measured thickness is used to determine the target resistance value based on Expression (1) in the determination step.

As a result, it is possible to manufacture a thermal head capable of accurately determining the target resistance value irrespective of the thickness value of the upper substrate and suppressing the variation in heating efficiency even when the resistance value varies for each substrate or each lot.

In the above-mentioned exemplary embodiment, the forming the heating resistor may include: a first step of forming a heating resistor having an arbitrary resistance value; a second step of measuring the resistance value of the heating resistor formed in the first step; and a third step of adjusting the resistance value of the heating resistor so as to reduce a difference between the resistance value measured in the second step and the target resistance value.

With this configuration, the heating resistor is formed without strictly adjusting the resistance value in the first step, and after the formation, the resistance value is measured in the second step. Then, in the third step, the resistance value is adjusted so as to approach the target resistance value. Thus, the heating resistor having the target resistance value can be formed more accurately.

Further, in the above-mentioned exemplary embodiment, the third step may include applying predetermined energy to the heating resistor to adjust the resistance value.

With this configuration, the resistance value of the heating resistor can be changed easily in a short period of time.

Further, in the above-mentioned exemplary embodiment, the applying the predetermined energy may include using a voltage pulse.

With this configuration, the resistance value of the heating resistor can be easily changed merely by applying a higher voltage pulse than in normal printing operation to the heating resistor, without using a special device for adjusting the resistance value of the heating resistor.

Further, in the above-mentioned exemplary embodiment, the applying the predetermined energy may include using laser light.

With this configuration, a resistance value of a heating resistor at a portion irradiated with the laser light can be changed. In addition, by changing the irradiation width of the laser light, the range of changing the resistance value of the heating resistor can be adjusted.

Further, according to another exemplary embodiment of the present invention, there is provided a thermal printer including a thermal head manufactured by the method of manufacturing a thermal head having any one of the above-mentioned configurations.

According to each of the above-mentioned exemplary embodiments of the present invention, there is an effect that the heating efficiency can be prevented from lowering by the variation in resistance value for each substrate or each lot.

DETAILED DESCRIPTION OF THE PREFERRED EMBODIMENT

Referring to the accompanying drawings, a method of manufacturing a thermal head according to an embodiment of the present invention is described below.

Figure 1:
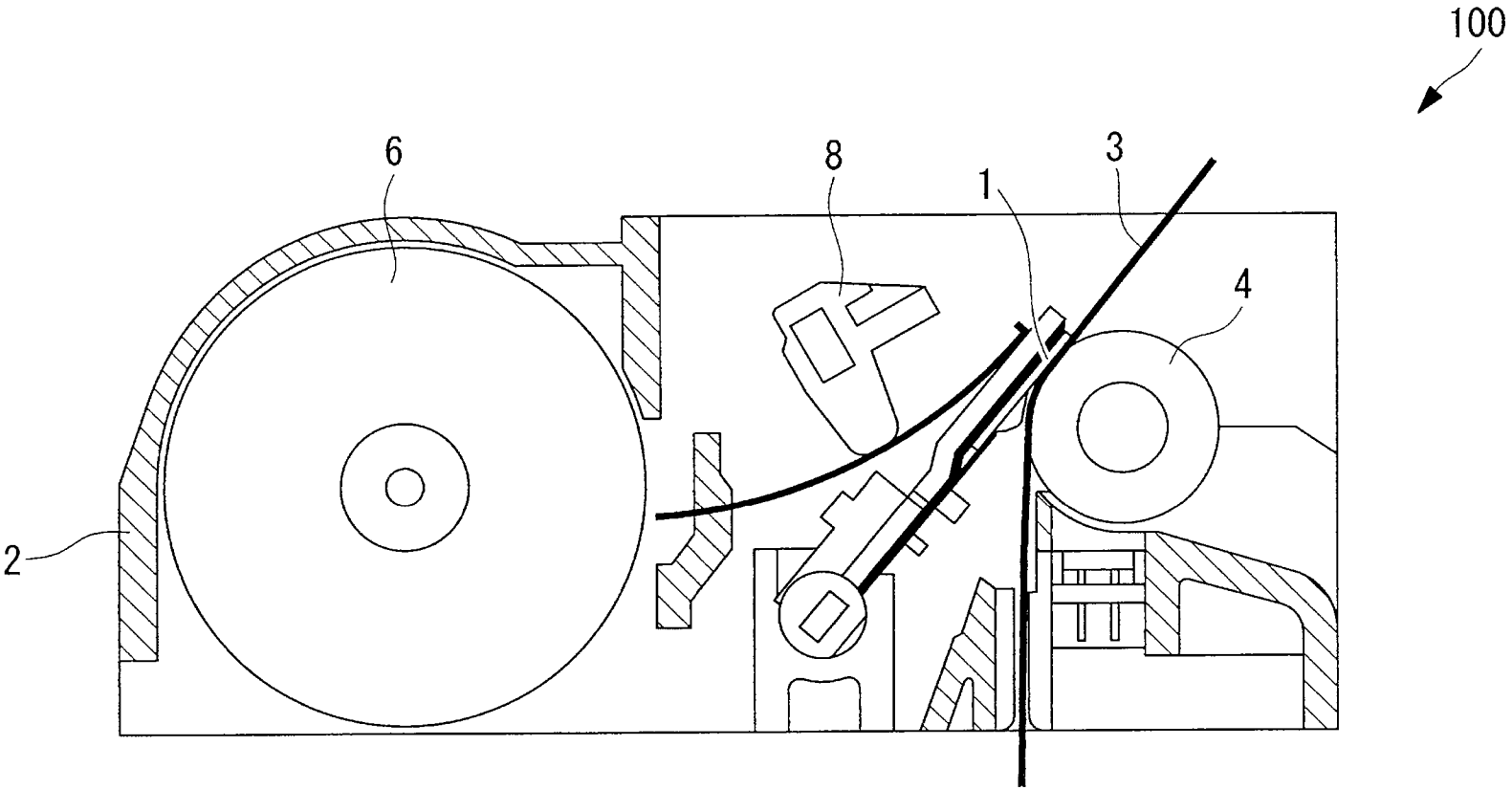
FIG. 1 is a schematic cross-sectional view of a thermal printer including a thermal head manufactured by a method of manufacturing a thermal head according to a first embodiment of the present invention.

The method of manufacturing a thermal head according to this embodiment is intended for manufacturing a thermal head 1 (see FIGS. 3 and 4) to be used in a thermal printer 100 as illustrated in FIG. 1, for example.

Figure 2:
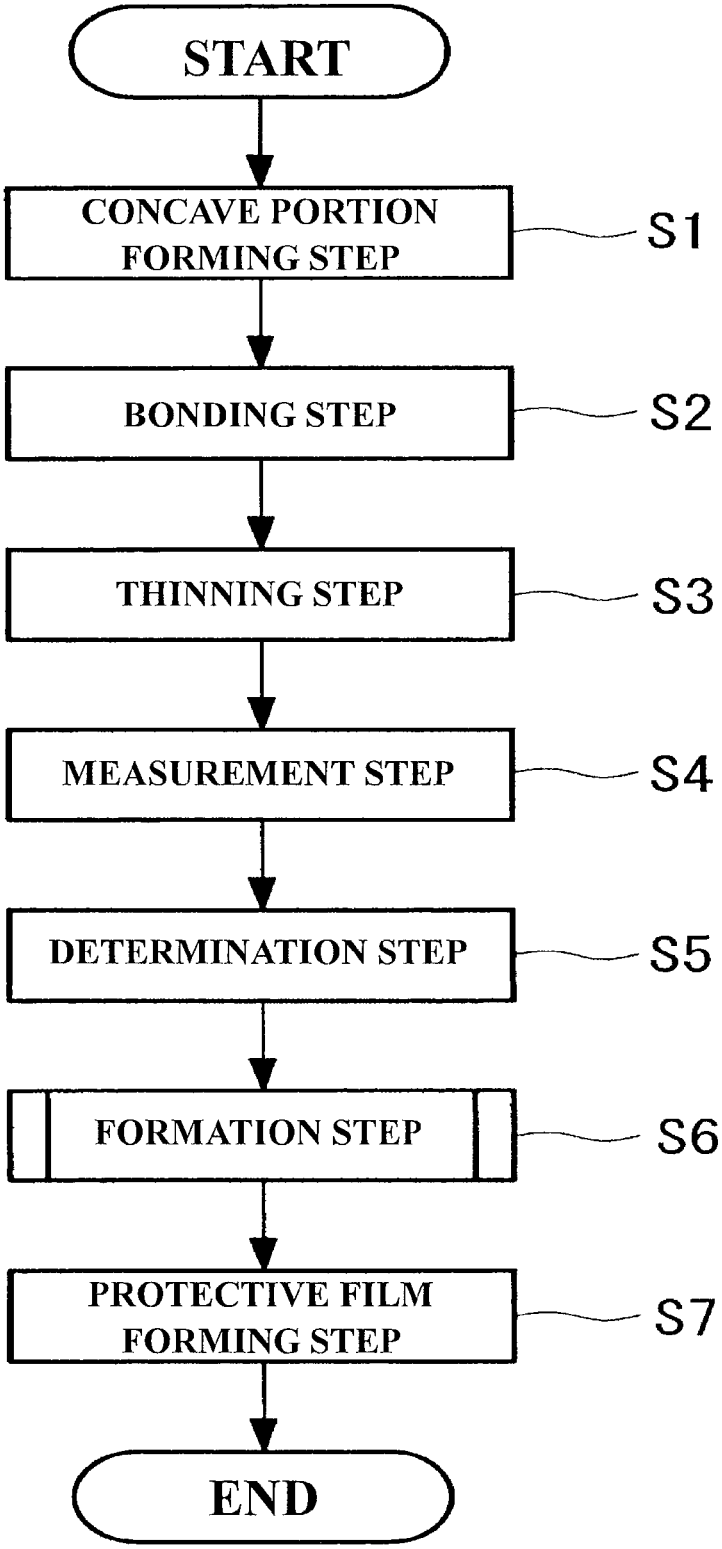
FIG. 2 is a flowchart of the method of manufacturing a thermal head according to the first embodiment of the present invention.

As illustrated in a flowchart of FIG. 2, the manufacturing method according to this embodiment includes a concave portion forming step S1 of forming a heat-insulating concave portion (concave portion) 32 opened in one surface of a flat support substrate 13, a bonding step S2 of bonding a flat upper substrate 11 onto the support substrate 13 having the heat-insulating concave portion 32 formed therein in a laminated state so as to close an opening of the heat-insulating concave portion 32, a thinning step S3 of thinning the upper substrate 11 bonded onto the support substrate 13, a measurement step S4 of measuring a thickness of the thinned upper substrate 11, a determination step S5 of determining a target resistance value of a heating resistor 14 based on the measured thickness of the upper substrate 11, a formation step S6 of forming the heating resistor 14 having the target resistance value determined in the determination step S5 and an electrode wiring 16 connected to the heating resistor 14 on a surface of the upper substrate 11 at a position opposed to the heat-insulating concave portion 32, and a protective film forming step S7 of forming a protective film 18 for covering and protecting a part of the surface of the upper substrate 11 including the heating resistor 14 and the electrode wiring 16.

Figure 3:
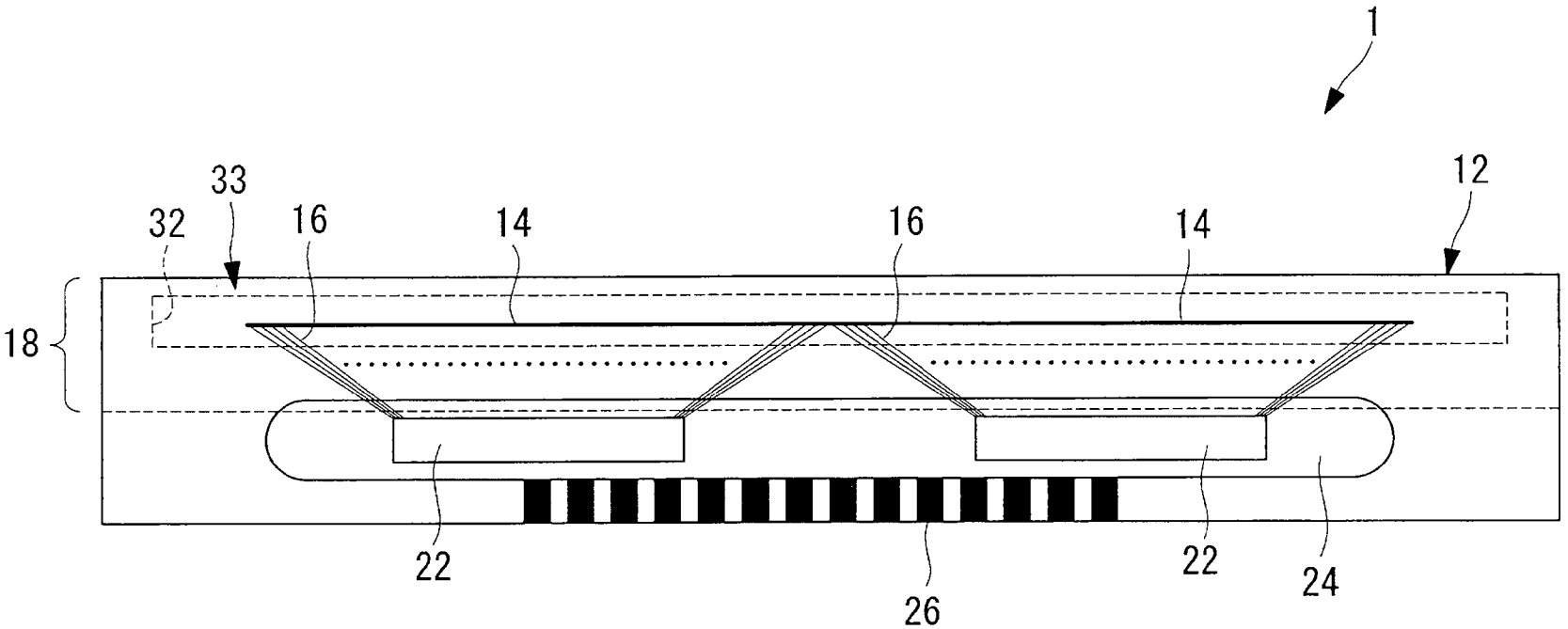
FIG. 3 is a plan view of the thermal head of FIG. 1 as seen from the protective film side.
Figure 4:
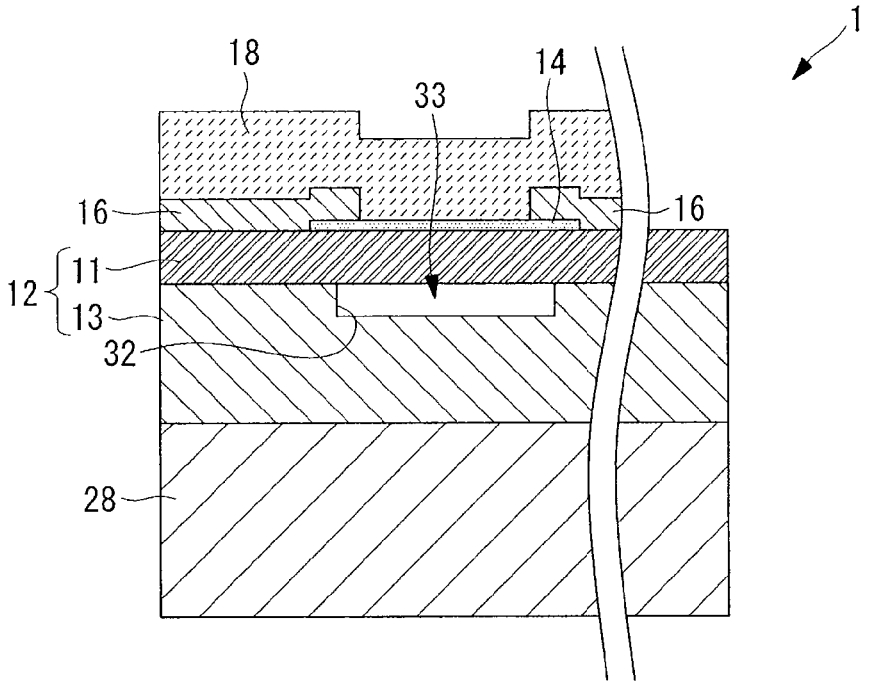
FIG. 4 is a vertical cross-sectional view of the thermal head of FIG. 3 orthogonal to a longitudinal direction thereof.

In FIG. 3, the heating resistor 14 is illustrated as a single straight line. Actually, however, a plurality of (such as 4,096) heating resistors 14 are arrayed at minute intervals in a longitudinal direction of a substrate main body 12.

The steps are specifically described below.

First, in the concave portion forming step S1, as the support substrate 13, an insulating glass substrate having a thickness of about 300 μm to about 1 mm is used. The rectangular heat-insulating concave portion 32 extending in a longitudinal direction of the support substrate 13 is formed in one surface of the support substrate 13 at a position opposed to the heating resistors 14 formed in the formation step S6.

The heat-insulating concave portion 32 can be formed by, for example, subjecting the one surface of the support substrate 13 to sandblasting, dry etching, wet etching, laser machining, or the like.

In the case where sandblasting is performed on the support substrate 13, the one surface of the support substrate 13 is covered with a photoresist material, and the photoresist material is exposed to light using a photomask of a predetermined pattern so as to be cured in part other than the region for forming the heat-insulating concave portion 32.

After that, the one surface of the support substrate 13 is cleaned and the uncured photoresist material is removed to obtain etching masks (not shown) having etching windows formed in the region for forming the heat-insulating concave portion 32. In this state, sandblasting is performed on the one surface of the support substrate 13 to form the heat-insulating concave portion 32 at a predetermined depth. It is preferred that the depth of the heat-insulating concave portion 32 be, for example, 10 μm or more and half or less of the thickness of the support substrate 13.

In the case where etching such as dry etching and wet etching is performed, as in the case of sandblasting, the etching masks having the etching windows formed in the region for forming the heat-insulating concave portion 32 are formed on the one surface of the support substrate 13. In this state, etching is performed on the one surface of the support substrate 13 to form the heat-insulating concave portion 32 at a predetermined depth.

As such an etching process, for example, wet etching using a hydrofluoric acid-based etchant or the like is available as well as dry etching such as reactive ion etching (RIE) and plasma etching. Note that, as a reference example, in the case of a single-crystal silicon support substrate, wet etching is performed using an etchant such as a tetramethylammonium hydroxide solution, a KOH solution, or a mixed solution of hydrofluoric acid and nitric acid.

Next, in the bonding step S2, the upper substrate 11 which is a glass substrate made of the same material as the support substrate 13 or a glass substrate having properties close to the material of the support substrate 13 is used. In this case, as the upper substrate 11, a substrate having a thickness of 100 μm or less is difficult to manufacture and handle, and is expensive. Thus, instead of directly bonding an originally thin upper substrate 11 onto the support substrate 13, the upper substrate 11 thick enough to be easily manufactured and handled is bonded onto the support substrate 13, and then the upper substrate 11 is processed by etching, polishing, or the like in the thinning step S3 so as to have a desired thickness.

First, all the etching masks are removed from the one surface of the support substrate 13, and the surface is cleaned. Then, the upper substrate 11 is attached onto the one surface of the support substrate 13 so as to close the heat-insulating concave portion 32. For example, the upper substrate 11 is attached directly onto the support substrate 13 without using any adhesive layer at room temperature.

When the one surface of the support substrate 13 is covered by the upper substrate 11, that is, the heat-insulating concave portion 32 is closed by the upper substrate 11, a heat-insulating cavity portion 33 is formed between the upper substrate 11 and the support substrate 13. In this state, the upper substrate 11 and the support substrate 13 attached together are subjected to heat treatment, to thereby bond the upper substrate 11 and the support substrate 13 by thermal fusion. The resultant substrate obtained by bonding the upper substrate 11 and the support substrate 13 together is hereinafter referred to as the substrate main body 12.

The heat-insulating cavity portion 33 has a communication structure opposed to all the heating resistors 14 formed on the layer thereabove. The heat-insulating cavity portion 33 functions as a hollow heat-insulating layer for preventing heat generated by the heating resistors 14 from transferring from the upper substrate 11 to the support substrate 13 side. Because the heat-insulating cavity portion 33 functions as the hollow heat-insulating layer, an amount of heat, which transfers in the direction toward the protective film 18 adjacent to one surface of the heating resistors 14, is increased to be more than an amount of heat, which transfers to the upper substrate 11 adjacent to the other surface of the heating resistors 14. Thermal paper 3 (see FIG. 1) is pressed against the protective film 18 during printing, and hence, when the amount of heat in this direction is increased, the amount of heat to be used for printing or the like is increased. Thus, use efficiency can be improved.

Next, in the thinning step S3, the upper substrate 11 bonded onto the support substrate 13 is processed by etching, polishing, or the like so as to have a desired thickness (for example, a thickness of about 10 μm to about 50 μm). In this way, the extremely thin upper substrate 11 can be formed on the one surface of the support substrate 13 easily at low cost.

As the etching of the upper substrate 11, various kinds of etching employable for forming the heat-insulating concave portion 32 as in the concave portion forming step S1 can be used. Further, as the polishing of the upper substrate 11, for example, chemical mechanical polishing (CMP) or the like, which is used for high precision polishing of a semiconductor wafer or the like, can be used.

In the measurement step S4, for example, light is radiated to a region of the upper substrate 11 opposed to the heat-insulating concave portion 32 of the support substrate 13, and based on the light reflected by the front surface and the rear surface of the upper substrate 11, the positions of the front surface and the rear surface are detected, to thereby measure the thickness of the upper substrate 11.

In this case, in the substrate main body 12 before the heating resistors 14 are formed, both the front surface of the upper substrate 11 opposed to the heat-insulating concave portion 32 and the rear surface thereof are in contact with air. That is, the front surface of the upper substrate 11 opposed to the heat-insulating concave portion 32 is exposed to the outside and is in contact with outside air, and the rear surface thereof is in contact with air inside the heat-insulating cavity portion 33 by closing the heat-insulating concave portion 32.

Figure 5:
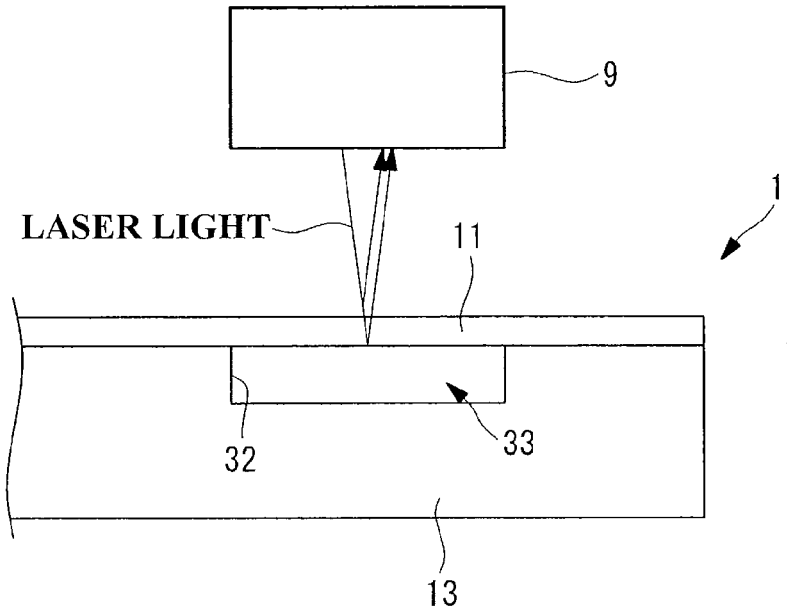
FIG. 5 is a schematic cross-sectional view illustrating how to measure a thickness of an upper substrate of the thermal head of FIG. 3.

Therefore, for example, as illustrated in FIG. 5, when blue laser light is radiated to this region of the upper substrate 11, the blue laser light is reflected by each of the front surface and the rear surface of the upper substrate 11 due to the difference in refractive index between the upper substrate 11 and the air. Then, merely by detecting the reflected light reflected by each of the front surface and the rear surface of the upper substrate 11 by a sensor 9 or the like, the accurate thickness dimension of the upper substrate 11 can be optically measured even in the state where the upper substrate 11 and the support substrate 13 are bonded together.

Next, in the determination step S5, based on the thickness of the upper substrate 11 measured in the measurement step S4, a target resistance value is calculated based on Expression (1) below.

$$Rh=R0\times(1+(D1+D0)/(D0+K)) \quad (1)$$

where Rh represents the target resistance value; R0, a design resistance value; D1, the thickness of the upper substrate 11; D0, a design thickness of the upper substrate 11; and K, a heating efficiency coefficient.

Figure 6:
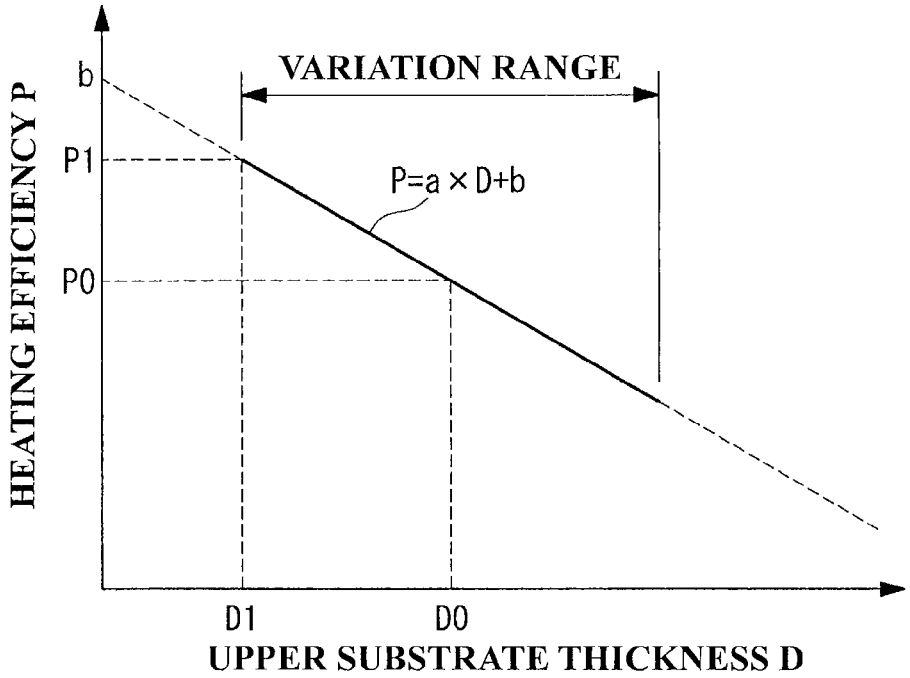
FIG. 6 is a graph showing a relationship between the thickness of the upper substrate and heating efficiency of a heating resistor.

More specifically, as shown in FIG. 6, the relationship between the thickness D of the upper substrate 11 and heating efficiency P changes linearly and hence is applied to the linear equation to define the expressions below.

$$P0=a\times D0+b \quad (2)$$

$$P1=a\times D1+b \quad (3)$$

where P0 represents heating efficiency when the upper substrate 11 has the design thickness D0, P1 represents heating efficiency when the upper substrate 11 has the thickness D1, and "a" and "b" are constants.

Based on the above, a change rate dP of the heating efficiency is determined as follows.

$$dP=(P1-P0)/P0 \quad (4)$$

Then, the target resistance value Rh can be regarded as follows.

$$Rh=R0+dP\times R0 \quad (5)$$

Expressions (2) to (5) above are modified to make replacement of b/a=K, to thereby obtain Expression (1).

That is, with the use of Expression (1) to calculate the target resistance value Rh of the heating resistor 14, a proper target resistance value Rh can be obtained for each of all the thickness dimensions of the upper substrate 11.

Next, in the formation step S6, a plurality of the heating resistors 14 each having the target resistance value determined in the determination step S5 and the electrode wiring 16 are formed on the surface of the upper substrate 11 at the positions opposed to the heat-insulating concave portion 32.

Figure 7:
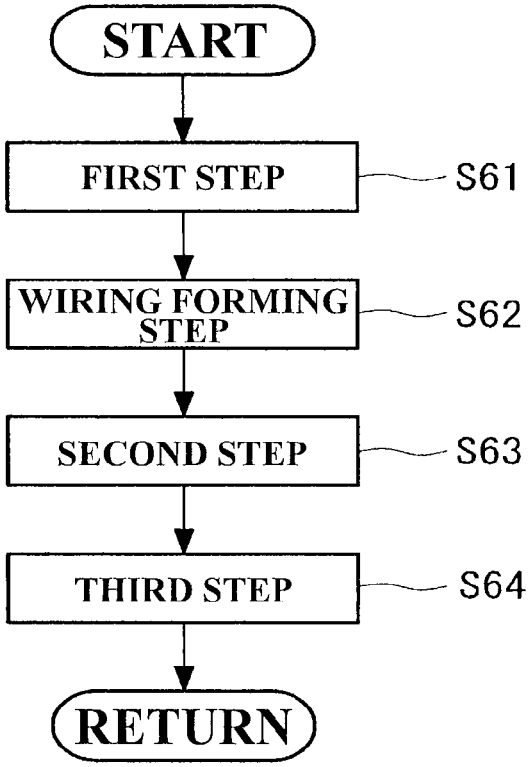
FIG. 7 is a flowchart of a formation step in the method of manufacturing a thermal head of FIG. 2.

As illustrated in FIG. 7, the formation step S6 includes a first step S61 of forming the heating resistor 14 having an appropriate resistance value, a wiring forming step S62 of forming the electrode wiring 16 on both sides of the heating resistor 14 formed in the first step S61, a second step S63 of measuring the resistance value of the heating resistor 14 formed in the first step S61, and a third step S64 of adjusting the resistance value of the heating resistor 14 so as to reduce a difference between the resistance value measured in the second step S63 and the target resistance value Rh.

In the first step S61, the heating resistors 14 are each formed on the surface of the upper substrate 11 so as to straddle the heat-insulating cavity portion 33 in its width direction, and are arrayed at predetermined intervals in the longitudinal direction of the heat-insulating cavity portion 33.

The heating resistor 14 can be formed by a thin film formation method such as sputtering, chemical vapor deposition (CVD), or vapor deposition. A thin film of a heating resistor material such as a Ta-based thin film or a silicide-based thin film is formed on the upper substrate 11. The thin film is then patterned by lift-off, etching, or the like to form the heating resistor 14 having a desired shape.

In the first step S61, for example, the heating resistor 14 having a resistance value higher than the target resistance value Rh is formed on the upper substrate 11.

Subsequently, in the wiring forming step S62, similarly to the first step S61, a film of a wiring material such as Al, Al—Si, Au, Ag, Cu, or Pt is formed on the upper substrate 11 by sputtering, vapor deposition, or the like. Then, the film thus obtained is patterned by lift-off or etching, or alternatively the wiring material is baked after screen-printing, to thereby form the electrode wiring 16.

The electrode wiring 16 includes individual electrode wirings connected to one ends of the respective heating resistors 14 in the direction orthogonal to the array direction thereof, and a common electrode wiring connected integrally to the other ends of all the heating resistors 14. Note that, the order of forming the heating resistors 14 and the electrode wiring 16 is optional. In pattering of a resist material for the lift-off or etching of the heating resistors 14 and the electrode wiring 16, a photomask is used to pattern the photoresist material.

In the second step S63, a probe is brought into contact with the electrode wiring 16 formed at the positions across the heating resistor 14 in the wiring forming step S62, and a known voltage is applied to the heating resistor 14. Then, a current flowing therethrough is measured to measure the resistance value. Because the probe is brought into contact with the electrode wiring 16, the resistance value of the heating resistor 14 can be measured without varying the resistance value.

In the third step S64, a difference between the resistance value of the heating resistor 14 measured in the second step S63 and the target resistance value Rh is calculated, and energy necessary for eliminating the difference is calculated. Then, the calculated energy is applied to the heating resistor 14 so that the resistance value of the heating resistor 14 is reduced to substantially match with the target resistance value Rh.

As the energy to be applied to the heating resistor 14 in the third step S64, for example, a voltage pulse may be used, or laser light may also be used.

In the case of applying a voltage pulse to the heating resistor 14, the resistance value of the heating resistor 14 can be easily changed merely by applying a higher voltage pulse than in normal printing operation to the heating resistor 14 via the wiring, without using a special device for adjusting the resistance value of the heating resistor 14.

In the case of applying laser light to the heating resistor 14, a resistance value of a heating resistor at a portion irradiated with the laser light can be changed in part. In addition, by changing the irradiation width of the laser light, the range of changing the resistance value of the heating resistor 14 can be adjusted easily.

Next, in the protective film forming step S7, on the upper substrate 11 having the heating resistors 14 and the electrode wiring 16 formed thereon, a film of a protective film material such as $SiO_2$, $Ta_2O_5$, SiAlON, $Si_3N_4$, or diamond-like carbon is formed by sputtering, ion plating, CVD, or the like, to thereby form the protective film 18. With the protective film 18 thus formed, the heating resistors 14 and the electrode wiring 16 can be protected from abrasion and corrosion.

On the surface of the upper substrate 11, for example, there are further formed a drive IC 22 electrically connected to each heating resistor 14 via the electrode wiring 16, an IC resin coating film 24 for covering the drive IC 22 for protection from abrasion and corrosion, and a plurality of (such as about 10) feeding portions 26 for supplying electric power energy to the heating resistors 14. The drive IC 22, the IC resin coating film 24, and the feeding portions 26 can be formed by using a known manufacturing method for the conventional thermal head.

The drive IC 22 controls heating operations of the heating resistors 14 individually, and is capable of driving a selected heating resistor 14 while controlling the voltage applied thereto via the individual electrode wiring. On the upper substrate 11, two drive ICs 22 are arranged at an interval along the array direction of the heating resistors 14, and one-half of the heating resistors 14 are connected to each drive IC 22 via the individual electrode wirings.

Through the steps described above, the thermal head 1 illustrated in FIGS. 3 and 4 is manufactured. The thermal head 1 manufactured in this way can be fixed to a heat sink plate 28 as a plate member made of a metal such as aluminum, a resin, ceramics, glass, or the like. With this, heat of the thermal head 1 is dissipated via the heat sink plate 28.

Further, the thermal head 1 can be used in the thermal printer 100 including a main body frame 2, a platen roller 4 disposed horizontally, the thermal head 1 disposed opposite to an outer peripheral surface of the platen roller 4, a paper feeding mechanism 6 for feeding an object to be printed, such as the thermal paper 3, between the platen roller 4 and the thermal head 1, and a pressure mechanism 8 for pressing the thermal head 1 against the thermal paper 3 with a predetermined pressing force.

In the thermal printer 100, the thermal head 1 and the thermal paper 3 are pressed against the platen roller 4 by the operation of the pressure mechanism 8. When a voltage is selectively applied to the individual electrode wirings by the drive IC 22, a current flows through the heating resistor 14 which is connected to the selected individual electrode wiring, and this heating resistor 14 generates heat. In this state, the pressure mechanism 8 operates to press the thermal paper 3 against a surface portion (printing portion) of the protective film 18 covering heating portions of the heating resistors 14, and then color is developed on the thermal paper 3 to be printed.

As described above, according to the method of manufacturing the thermal head 1 of this embodiment, the upper substrate 11 having the heating resistors 14 formed on the surface thereof functions as a heat storage layer. Accordingly, when the upper substrate 11 is thinned in the thinning step S3, the heat capacity as the heat storage layer can be reduced to suppress the amount of heat that dissipates to the upper substrate 11 side among the amount of heat generated by the heating resistors 14. Thus, the available amount of heat can be increased.

In this case, the available amount of heat depends on the thickness of the upper substrate 11 thinned in the thinning step S3. However, the target resistance value is determined in the determination step S5 based on the thickness of the thinned upper substrate 11 measured in the measurement step S4. Therefore, in the formation step S6, the heating resistor 14 capable of accurately generating an available amount of heat that takes into account the amount of heat which dissipates to the upper substrate 11 side can be formed irrespective of the thickness of the thinned upper substrate 11.

Therefore, it is possible to easily manufacture the highly-efficient thermal head 1 capable of accurately outputting a target heating amount that takes into account the amount of heat which is not utilized and wasted.

In particular, the target resistance value Rh is calculated from Expression (1) based on the thickness of the upper substrate 11, and hence there is an advantage that it is possible to manufacture the thermal head 1 having a little variation in heating efficiency irrespective of the variation in resistance value for each lot or each substrate and irrespective of the thickness of the upper substrate 11.

Note that, in this embodiment, in the measurement step S4, the thickness of the upper substrate 11 is measured optically. Alternatively, however, for example, the thickness of the support substrate 13 may be measured in advance before the bonding step S2, and in the measurement step S4, the thickness of the upper substrate 11 may be calculated by subtracting the thickness dimension of the support substrate 13 from the thickness dimension of the thinned substrate main body 12.

Figure 8:
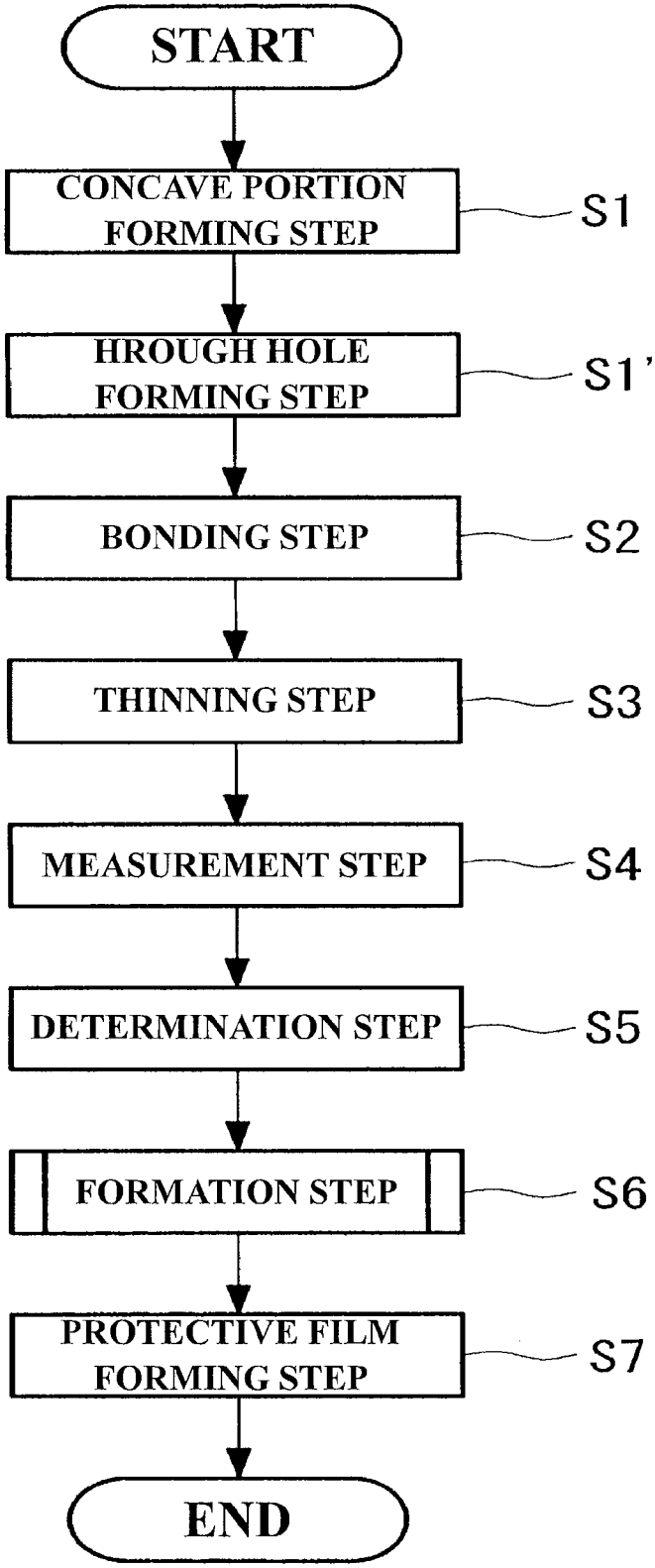
FIG. 8 is a flowchart illustrating a modified example of the method of manufacturing a thermal head of FIG. 2.
Figure 9:
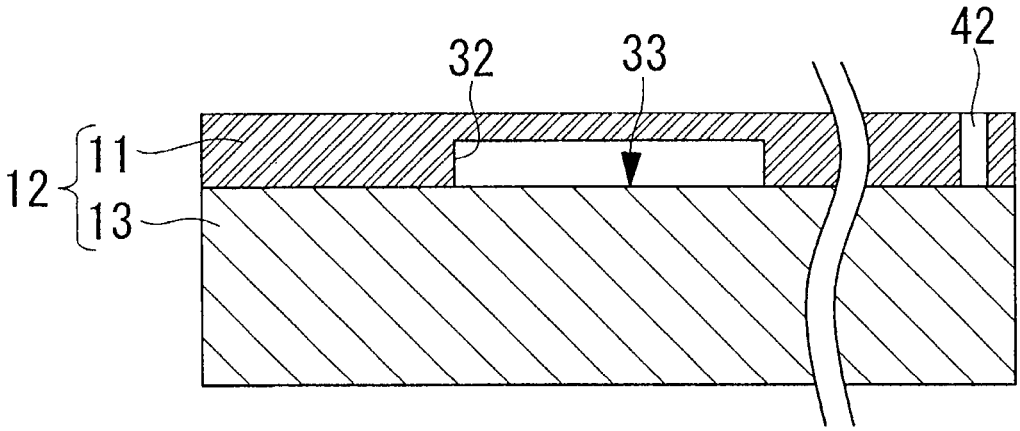
FIG. 9 is a vertical cross-sectional view of a thermal head manufactured by the method of manufacturing a thermal head of FIG. 8 orthogonal to a longitudinal direction thereof.

Further, for example, as illustrated in a flowchart of FIG. 8, the manufacturing method may include, before the bonding step S2, a through hole forming step S1' of forming a through hole 42 (see FIG. 9) passing through the upper substrate 11 in the thickness direction at a position at which the heating resistor 14 is not formed. Then, in the bonding step S2, the upper substrate 11 and the support substrate 13 may be bonded together so that one end of the through hole 42 is closed by the one surface of the support substrate 13, and in the measurement step S4, the depth of the through hole 42 of the upper substrate 11 bonded onto the support substrate 13 may be measured.

With this configuration, even in the state where the upper substrate 11 and the support substrate 13 are bonded together, for example, only the thickness of the upper substrate 11 can be measured by measuring the depth of the through hole 42 while inserting a measuring instrument such as a micrometer into the through hole 42. The through hole 42 may be formed in the concave portion forming step S1 similarly and simultaneously with the formation of the heat-insulating concave portion 32.

Further, the formation step S6 may be performed before the measurement step S4.

Further, in the first step S61, the heating resistor 14 having a resistance value higher than the target resistance value Rh is formed. Alternatively, however, the heating resistor 14 having a resistance value lower than the target resistance value Rh may be formed.

Further, in this embodiment, in the formation step S6, the heating resistor 14 having an appropriate resistance value is formed in the first step, and after that, the resistance value is adjusted in the third step. Alternatively, however, the heating resistor 14 having the target resistance value Rh determined in the determination step S5 may be formed from the beginning.

Hereinabove, the embodiment of the present invention has been described in detail with reference to the accompanying drawings. However, specific configurations of the present invention are not limited to the embodiment, and include design modifications and the like without departing from the gist of the present invention. For example, the present invention is not particularly limited to the above-mentioned embodiment and modified example, and may be applied to an embodiment in an appropriate combination of the embodiment and modified example.

Further, in the above-mentioned embodiment, the heat-insulating concave portion 32 provided on the support substrate 13 side has been exemplified as the concave portion. Alternatively, however, the heat-insulating concave portion 32 may be provided on the upper substrate side, or may be formed of, for example, a through hole passing through the support substrate 13 in the thickness direction.

What is claimed is:

1. A method of manufacturing a thermal head, comprising:

bonding a support substrate and an upper substrate, which have a flat shape, together in a laminated state, the support substrate and the upper substrate having opposed surfaces, at least one of which includes a concave portion;

thinning the upper substrate bonded onto the support substrate in the bonding;

measuring a thickness of the upper substrate thinned in the thinning;

determining a target resistance value of a heating resistor from the following expression based on the thickness of the upper substrate measured in the measuring; and forming the heating resistor having the target resistance value determined in the determining on a surface of the upper substrate thinned in the thinning at a position opposed to the concave portion, $$Rh=R0\times(1+(D1+D0)/(D0+K)) \quad (1)$$

where Rh represents the target resistance value; R0, a design resistance value; D1, the thickness of the upper substrate; D0, a design thickness of the upper substrate; and K, a heating efficiency coefficient.

2. A method of manufacturing a thermal head according to claim 1, wherein the forming the heating resistor comprises:

a first step of forming a heating resistor having an arbitrary resistance value;

a second step of measuring the resistance value of the heating resistor formed in the first step; and a third step of adjusting the resistance value of the heating resistor so as to reduce a difference between the resistance value measured in the second step and the target resistance value.

3. A method of manufacturing a thermal head according to claim 2, wherein the third step comprises applying predetermined energy to the heating resistor to adjust the resistance value.

4. A method of manufacturing a thermal head according to claim 3, wherein the applying the predetermined energy comprises using a voltage pulse.

5. A method of manufacturing a thermal head according to claim 3, wherein the applying the predetermined energy comprises using laser light.

* * * * *